US008971561B2

(12) United States Patent
Howes et al.

(10) Patent No.: US 8,971,561 B2
(45) Date of Patent: Mar. 3, 2015

(54) EARPHONE HAVING A CONTROLLED ACOUSTIC LEAK PORT

(75) Inventors: Michael B. Howes, Mountain View, CA (US); Yacine Azmi, San Francisco, CA (US); Scott P. Porter, Cupertino, CA (US); Jonathan S. Aase, Sunnyvale, CA (US); Andrew P. Bright, San Francisco, CA (US); Christopher R. Wilk, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 108 days.

(21) Appl. No.: 13/528,566

(22) Filed: Jun. 20, 2012

(65) Prior Publication Data

US 2013/0343594 A1 Dec. 26, 2013

(51) Int. Cl.
*H04R 25/00* (2006.01)

(52) U.S. Cl.
USPC ..... 381/370; 381/380

(58) Field of Classification Search
CPC .. H04R 1/1008; H04R 1/1016; H04R 1/1058; H04R 2201/107; H04R 2420/07; H04R 25/652
USPC ..... 381/370, 371; 181/129, 130, 135
See application file for complete search history.

(56) References Cited

U.S. PATENT DOCUMENTS

| | | | | |
|---|---|---|---|---|
| 4,742,887 | A | 5/1988 | Yamagishi | |
| 5,298,692 | A | 3/1994 | Ikeda et al. | |
| 5,949,896 | A * | 9/1999 | Nageno et al. | 381/380 |
| 6,668,064 | B1 | 12/2003 | Lin | |
| 7,634,099 | B2 | 12/2009 | Harvey et al. | |
| 7,916,888 | B2 | 3/2011 | Sapiejewski et al. | |
| 8,594,351 | B2 | 11/2013 | Harlow et al. | |
| 2007/0154050 | A1 | 7/2007 | Kim | |
| 2007/0189570 | A1 | 8/2007 | Matsuo et al. | |
| 2008/0013774 | A1 * | 1/2008 | Hosaka et al. | 381/380 |
| 2008/0019554 | A1 | 1/2008 | Krywko | |
| 2009/0041281 | A1 | 2/2009 | Chang | |
| 2009/0116676 | A1 | 5/2009 | Welsh et al. | |

(Continued)

FOREIGN PATENT DOCUMENTS

| | | |
|---|---|---|
| JP | 2011182201 | 9/2011 |
| TW | M426234 | 4/2012 |

OTHER PUBLICATIONS

PCT International Search Report for PCT/US2013/046639, mailed Sep. 5, 2013.

(Continued)

*Primary Examiner* — Brian Ensey
(74) *Attorney, Agent, or Firm* — Blakely, Sokoloff, Taylor & Zafman LLP

(57) ABSTRACT

An earphone having an earphone housing including a tip portion dimensioned to be inserted into an ear canal of a wearer, a body portion extending outward from the tip portion, and a tube portion extending from the body portion. The body portion has a face portion that faces a pinna region of the ear when the tip portion is inserted into the ear canal. A primary output opening, that outputs sound from a driver in the housing to the ear canal, is formed in the tip portion. A secondary output opening, that outputs air from the ear canal to the surrounding environment, is formed in the face portion. The primary output opening and the secondary output opening are horizontally aligned when the tube portion is positioned vertically downward and an angle formed between the primary output opening, the tube portion and the secondary output opening is less than 90 degrees.

20 Claims, 10 Drawing Sheets

(56) References Cited

U.S. PATENT DOCUMENTS

| | | | |
|---|---|---|---|
| 2009/0123010 | A1 | 5/2009 | Cano et al. |
| 2009/0147981 | A1 | 6/2009 | Blanchard et al. |
| 2012/0076341 | A1 | 3/2012 | Ozawa |
| 2013/0136290 | A1 | 5/2013 | Huang et al. |

OTHER PUBLICATIONS

PCT International Preliminary Report on Patentability for PCT/US2013/046639 mailed Dec. 31, 2014.

Taiwanese Office Action dated Nov. 10, 2014, TW Appln. 102121805 with English-language translation, 17 pages.

* cited by examiner

EARPHONE HAVING A CONTROLLED ACOUSTIC LEAK PORT

FIELD

An embodiment of the invention is directed to an earphone assembly having a controlled acoustic leak port. Other embodiments are also described and claimed.

BACKGROUND

Whether listening to an MP3 player while traveling, or to a high-fidelity stereo system at home, consumers are increasingly choosing intra-canal and intra-concha earphones for their listening pleasure. Both types of electro-acoustic transducer devices have a relatively low profile housing that contains a receiver or driver (an earpiece speaker). The low profile housing provides convenience for the wearer, while also providing very good sound quality.

Intra-canal earphones are typically designed to fit within and form a seal with the user's ear canal. Intra-canal earphones therefore have an acoustic output tube portion that extends from the housing. The open end of the acoustic output tube portion can be inserted into the wearer's ear canal. The acoustic output tube portion typically forms, or is fitted with, a flexible and resilient tip or cap made of a rubber or silicone material. The tip may be custom molded for the discerning audiophile, or it may be a high volume manufactured piece. When the tip portion is inserted into the user's ear, the tip compresses against the ear canal wall and creates a sealed (essentially airtight) cavity inside the canal. Although the sealed cavity allows for maximum sound output power into the ear canal, it can amplify external vibrations, thus diminishing overall sound quality.

Intra-concha earphones, on the other hand, typically fit in the outer ear and rest just above the inner ear canal. Intra-concha earphones do not typically seal within the ear canal and therefore do not suffer from the same issues as intra-canal earphones. Sound quality, however, may not be optimal to the user because sound can leak from the earphone and not reach the ear canal. In addition, due to the differences in ear shapes and sizes, different amounts of sound may leak thus resulting in inconsistent acoustic performance between users.

SUMMARY

An embodiment of the invention is an earphone including an earphone housing having a tip portion dimensioned to be inserted into an ear canal of a wearer, a body portion extending outward from the tip portion, and a tube portion extending from the body portion. A primary output opening for outputting sound generated by a driver within the body portion into the ear canal is formed in the tip portion. A secondary output opening for venting air to the external environment is formed in a face of the body portion. The face of the body portion faces a pinna region of the ear when the tip portion is inserted into the ear canal. The primary output opening and the secondary output opening can be horizontally aligned with one another and face different directions such that they form an acute angle with respect to one another.

The secondary output opening may serve as a controlled leak port to expose an acoustic pressure within the earphone to the external, surrounding environment. In this aspect, the secondary output opening may be calibrated to modify an acoustic response of the earphone. For example, secondary output opening may be calibrated to reduce a sound pressure level at a peak around 6 kHz and tune a frequency response of the earphone to improve overall earphone performance.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
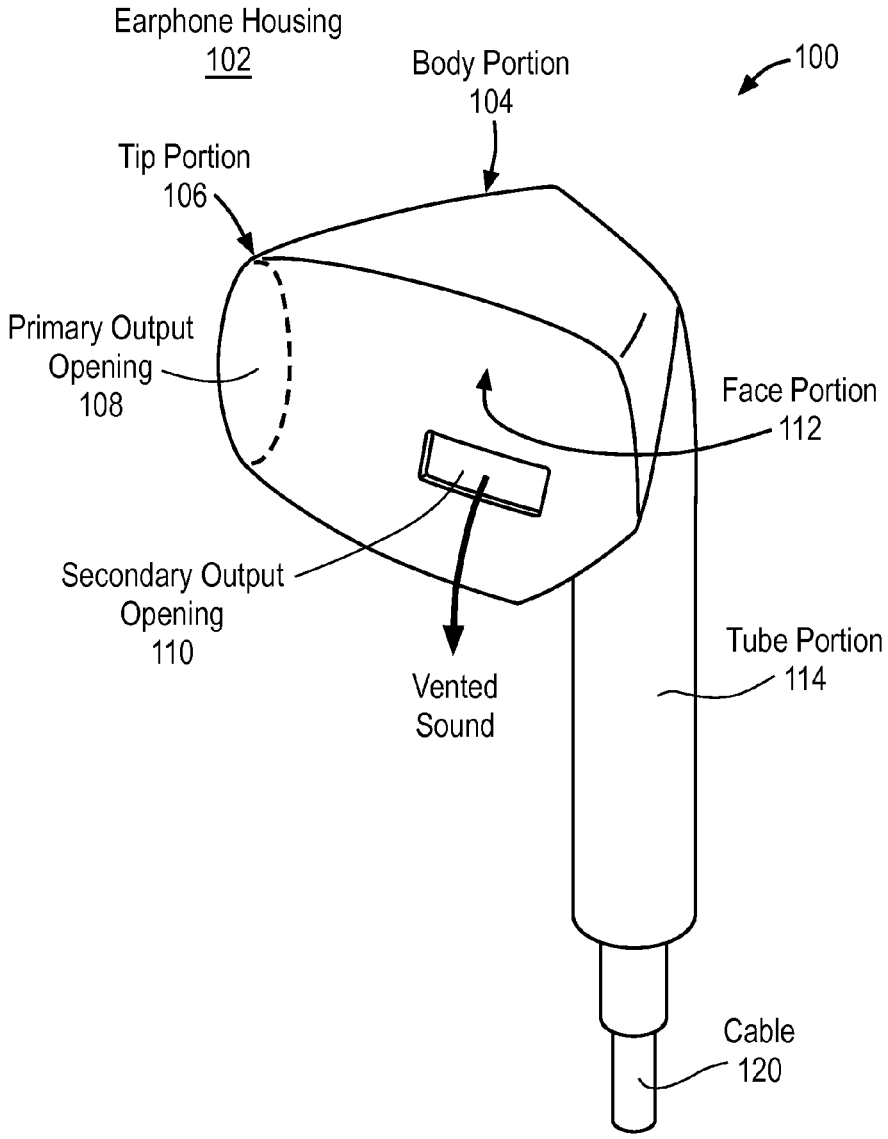
FIG. 1 is a perspective view of one embodiment of an earphone.

FIG. 1 is a perspective view of one embodiment of an earphone. In one embodiment, earphone 100 may be dimensioned to rest within a concha of an ear (in this example, a right ear) and extend into the ear canal for improved acoustic performance. In this aspect, earphone 100 may be considered a hybrid of an intra-concha earphone and an intra-canal earphone. Representatively, earphone housing 102 may form a body portion 104 which rests within the concha like an intra-concha earphone and a tip portion 106 which extends into the ear canal similar to an intra-canal earphone. A receiver or driver (not shown) may be contained within housing 102. Aspects of the driver will be discussed in more detail below.

Tube portion 114 may extend from body portion 104. Tube portion 114 may be dimensioned to contain cable 120, which may contain wires extending from a powered sound source (not shown) to the driver. The wires may carry an audio signal that will be audibilized by the driver. In addition, tube portion 114 may be dimensioned to provide an acoustic pathway that enhances an acoustic performance of earphone 100. This feature will be described in more detail in reference to FIG. 7. In some embodiments, tube portion 114 extends from body portion 104 in a substantially perpendicular direction such that when body portion 104 is in a substantially horizontal orientation, tube portion 114 extends vertically downward from body portion 104.

Housing 102 may include a primary output opening 108 and a secondary output opening 110. Primary output opening 108 may be formed within tip portion 106. When tip portion 106 is positioned within the ear canal, primary output opening 108 outputs sound produced by the driver (in response to the audio signal) into the ear canal. Primary output opening 108 may have any size and dimensions suitable for achieving a desired acoustic performance of earphone 100.

Secondary output opening 110 may be formed within body portion 104. Secondary output opening 110 may be dimensioned to vent the ear canal and/or output sound from earphone 100 to the external environment outside of earphone 100. The external or surrounding environment should be understood as referring to the ambient environment or atmosphere outside of earphone 100. In this aspect, secondary output opening 110 may serve as a leak port that allows a relatively small and controlled amount of air to leak from the ear canal and earphone housing 102 to the external environment. Secondary output opening 110 is considered a controlled leak port, as opposed to an uncontrolled leak, because its size and shape are selected to achieve an amount of air leakage found acoustically desirable and that can be consistently maintained not only each time the same user wears the earphone but also between users. This is in contrast to typical intra-concha earphones which allow a substantial amount of air leakage between the earphone and the ear canal that can vary depending upon the positioning of the earphone within the ear and the size of the user's ear. Thus the amount of air leakage is uncontrolled in that case, resulting in an inconsistent acoustic performance.

Controlling the amount of air leaking out of secondary output opening 110 is important for many reasons. For example, as the driver within earphone 100 emits sound into the ear canal, a high pressure level at low frequencies may occur inside the ear canal. This high pressure may cause unpleasant acoustic effects to the user. As previously discussed, tip portion 106 extends into the ear canal and therefore prevents a substantial amount of air from leaking out of the ear canal around tip portion 106. Instead, air is directed out of the secondary output opening 110. Secondary output opening 110 provides a controlled and direct path from the ear canal out of the earphone housing 102 so that an acoustic pressure within the ear canal can be exposed or vented to the surrounding environment, outside of earphone 100. Reducing the pressure within the ear canal improves the user's acoustic experience. Secondary output opening 110 has a controlled size and shape such that about the same amount of air leakage is expected to occur regardless of the size of the user's ear canal. This in turn, results in a substantially consistent acoustic performance of earphone 100 between users. In addition, in one embodiment, the amount of air leakage can be controlled so that increased, if not maximum, sound output reaches the ear canal.

Secondary output opening 110 may also be calibrated to tune a frequency response and/or provide a consistent bass response of earphone 100 amongst the same user and across users. Secondary output opening 110 is calibrated in the sense that it has been tested or evaluated (in at least one specimen of a manufactured lot) for compliance with a given specification or design parameter. In other words, it is not just a random opening, but it has been intentionally formed for a particular purpose, namely to change the frequency response of the earphone in a way that helps to tune the frequency response and/or provide a consistent bass response amongst the same user and across users. In this aspect, secondary output opening 110 can be calibrated to modify a sound pressure frequency response of the primary output opening 108.

For example, in one embodiment, secondary output opening 110 may be used to increase a sound pressure level and tune frequency response at a peak around 6 kHz. In particular, it is recognized that overall sound quality improves for the listener as the secondary output opening 110 becomes larger. A large opening, however, may not be aesthetically appealing therefore it is desirable to maintain the smallest opening possible. A smaller opening, however, may not result in a desired acoustic performance around a peak of 6 kHz (e.g., acoustic inductance may increase). In this aspect, a size and/or shape of secondary output opening 110 has been tested and calibrated to have a relatively small size and desirable shape yet still achieve an optimal acoustic performance at a peak of 6 kHZ. For example, secondary output opening 110 may have a surface area of from about 3 $mm^2$ to about 15 $mm^2$, for example, from about 7 $mm^2$ to about 12 $mm^2$, for example 9 $mm^2$. In one embodiment, secondary output opening 110 may have an aspect ratio of about 3:2. Secondary output opening 110 may therefore have, for example, an elongated shape such as a rectangular shape or an oval shape. It is contemplated, however, that secondary output opening 110 may have other sizes and shapes found suitable for achieving a desired acoustic performance.

The size and shape of secondary output opening 110 may also be calibrated to provide earphone 100 with a more consistent bass response, for the same user and between different users. In particular, as previously discussed, when air leakage from an earphone to the surrounding environment is uncontrolled (e.g., when it occurs through a gap between the ear canal and outer surface of the earphone housing), the acoustic performance, which can include the bass response of the earphone, will vary depending upon the size of the user's ear and the positioning within the ear. Since secondary output opening 110 is of a fixed size and shape and therefore capable of venting an acoustic pressure within the ear canal and/or earphone 100 in substantially the same manner, regardless of the size of a user's ear and positioning of earphone 100 within the ear, earphone 100 has a substantially consistent bass response each time the same user wears earphone 100 and between different users.

In addition, it is believed that secondary output opening 110 may reduce the amount of externally radiated sound (e.g. uncontrolled sound leakage), as compared to an earphone without secondary output opening 110. In this aspect, for the same sound pressure level produced by the driver diaphragm, earphone 100 having secondary output opening 110 would produce less externally radiated sound resulting in more sound reaching the ear canal than an earphone without secondary output opening 110.

To ensure consistent venting to the surrounding environment, secondary output opening 110 may be formed within a portion of housing 102 that is not obstructed by the ear when earphone 100 is positioned within the ear. In one embodiment, secondary output opening 110 is formed within face portion 112 of body portion 104. Face portion 112 may face a pinna region of the ear when tip portion 106 is positioned within the ear canal. Secondary output opening 110 therefore faces the pinna region when earphone 100 is positioned within the ear. In addition, where secondary output opening 110 has an elongated shape, the longest dimension may be oriented in a substantially horizontal direction when earphone 100 is positioned in the ear such that it extends outward from the ear canal. In this aspect, a substantial, if not the entire, surface area of secondary output opening 110 remains unobstructed by the ear when tip portion 106 is positioned within the ear canal. In other embodiments, secondary output opening 110 may have any orientation within face portion 112 suitable for allowing sound from the ear canal and/or earphone housing 102 to vent to the outside environment, e.g., vertical or diagonal.

Earphone housing 102, including tip portion 106 and body portion 104 may be formed of a substantially non-compliant and non-resilient material such as a rigid plastic or the like. In this aspect, unlike typical intra-canal earphones, although tip portion 106 can contact and form a seal with the ear canal, it is not designed to form an airtight seal as is typically formed by intra-canal earphones that have a compliant or resilient tip. Tip portion 106, body portion 104 and tube portion 114 may be formed of the same or different materials. In one embodiment, tip portion 106 and body portion 104 may be molded into the desired shape and size as separate pieces or one integrally formed piece using any conventional molding process. In addition, tip portion 106 may have a tapered shape that tapers from body portion 104 so that the end of tip portion 106 facing the ear canal has a reduced size or diameter relative to body portion 104 and fits comfortably within the ear canal. Thus, earphone 100 does not require a separate flexible (resilient or compliant) tip such as a rubber or silicon tip to focus the sound output. In other embodiments, tip portion 106 may be formed of a compliant or flexible material or be fitted with a compliant cap that will create a sealed cavity within the ear canal.

Figure 2:
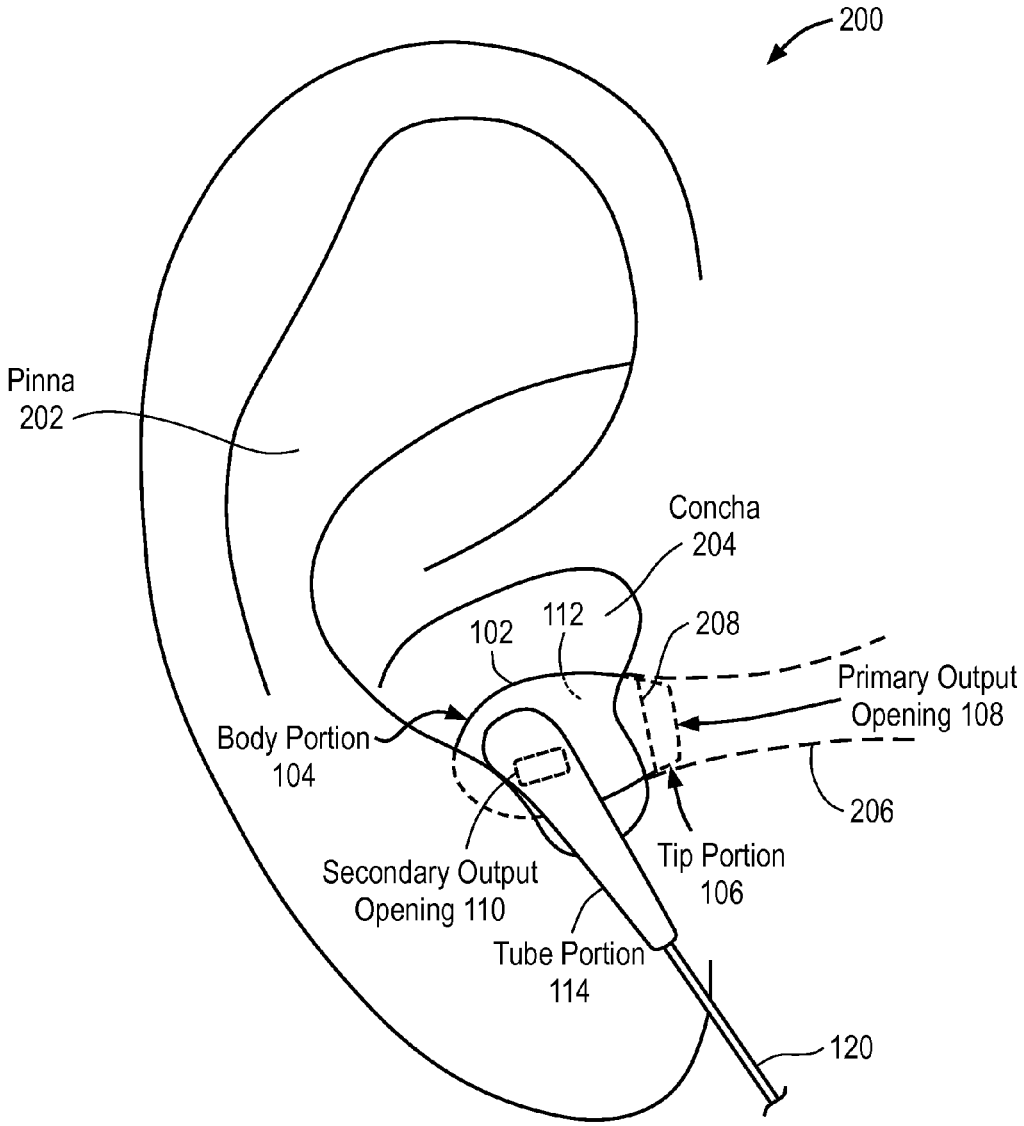
FIG. 2 illustrates a side view of one embodiment of an earphone worn within a right ear.

FIG. 2 illustrates a side view of one embodiment of an earphone worn within a right ear. Ear 200 includes pinna portion 202, which is the meaty portion of the external ear that projects from the side of the head. Concha 204 is the curved cavity portion of pinna portion 202 that leads into ear canal 206. Earphone 100 may be positioned within ear 200 so that tip portion 106 extends into ear canal 206 and body portion 104 rests within concha 204. The tapered shape of tip portion 106 may allow for contact region 208 of tip portion 106 to contact the walls of ear canal 206 and form a seal with ear canal 206. As previously discussed, tip portion 106 can be made of a non-compliant or rigid material such as plastic therefore the seal may not be airtight. Alternatively, the seal formed around tip portion 106 at contact region 208 may be airtight.

Face portion 112 of body portion 104 faces pinna portion 202 when earphone 100 is positioned within ear 200. Secondary output opening 110 also faces pinna portion 202 such that sound exits secondary output opening 110 toward pinna portion 202 and into the surrounding environment. Although secondary output opening 110 faces pinna portion 202, due to its size, orientation and positioning about face portion 112, it is not obstructed by pinna portion 202.

Figure 3:
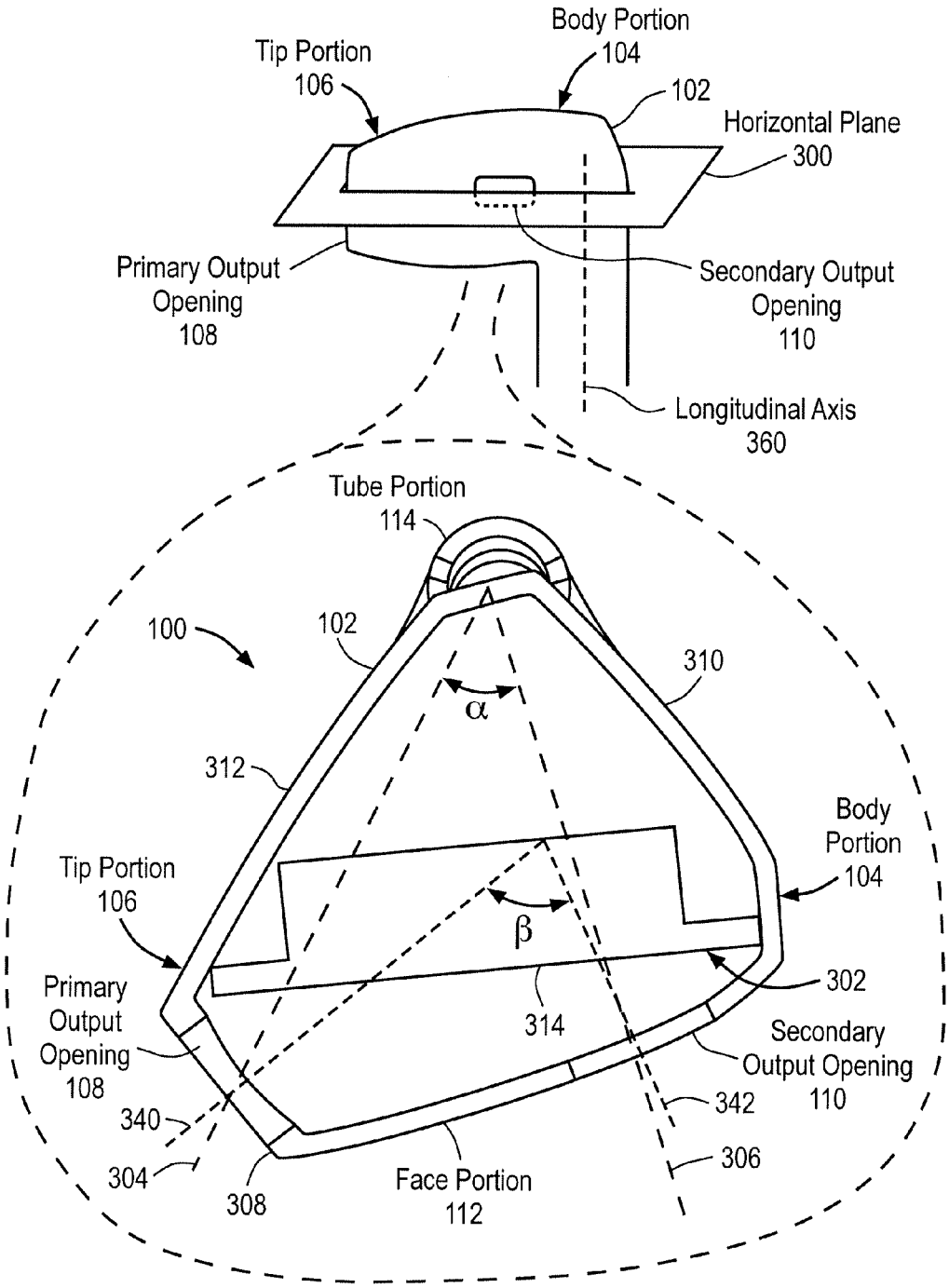
FIG. 3 illustrates a top perspective cut out view of one embodiment of an earphone.

FIG. 3 illustrates a top perspective cut out view of one embodiment of an earphone. In particular, from this view it can be seen that primary output opening 108 and secondary output opening 110 are positioned along different sides of housing 102 such that the openings face different directions and form an acute angle with respect to one another, as described below. For example, primary output opening 108 may be formed in end portion 308 that is opposite back side 310 and faces the ear canal while secondary output opening 110 may be formed in face portion 112 that faces the pinna portion and is opposite front side 312 of housing 102.

When tube portion 114 is vertically orientated, primary output opening 108 and secondary output opening 110 intersect the same horizontal plane 300, i.e. a plane that is essentially perpendicular to a length dimension or longitudinal axis 360 of tube portion 114. An angle ($\alpha$) formed between primary output opening 108 and secondary output opening 110 and within the horizontal plane 300 may be an acute angle. In one embodiment, angle ($\alpha$) may be defined by line 304 and line 306 radiating from a longitudinal axis 360 of tube portion 114 and extending through a center of primary output opening 108 and a center of secondary output opening 110, respectively. In one embodiment, angle ($\alpha$) may be less than 90 degrees, for example, from about 80 degrees to about 20 degrees, from about 65 degrees to about 35 degrees, or from 40 to 50 degrees, for example, 45 degrees.

Alternatively, an orientation of primary output opening 108 and secondary output opening 110 may be defined by an angle ($\beta$) formed by a first axis 340 through a center of primary output opening 108 and a second axis 342 through a center of secondary output opening 110. First axis 340 and second axis 342 may be formed within the same horizontal plane 300. Angle ($\beta$) between first axis 340 and second axis 342 may be less than 90 degrees, for example, from about 85 degrees to 45 degrees, representatively from 60 degrees to 70 degrees.

In other embodiments, an orientation of primary output opening 108 and secondary output opening 110 may be defined with respect to driver 302. In particular, as can be seen from this view, front face 314 of driver 302 faces both primary output opening 108 and secondary output opening 110 but is not parallel to either the side 308 or the face portion 112 in which the openings 108, 110 are formed. Rather, an end portion of driver 302 extends into tip portion 106 toward primary output opening 108 and the remaining portion of driver 302 extends along face portion 112. In this aspect, while both the primary output opening 108 and secondary output opening 110 may be considered in front of drive front face 314, the entire area of secondary output opening 110 may face driver front face 314 while only a portion of primary output opening 108 may face driver front face 314, with the rest facing a side of driver 302.

Figure 4:
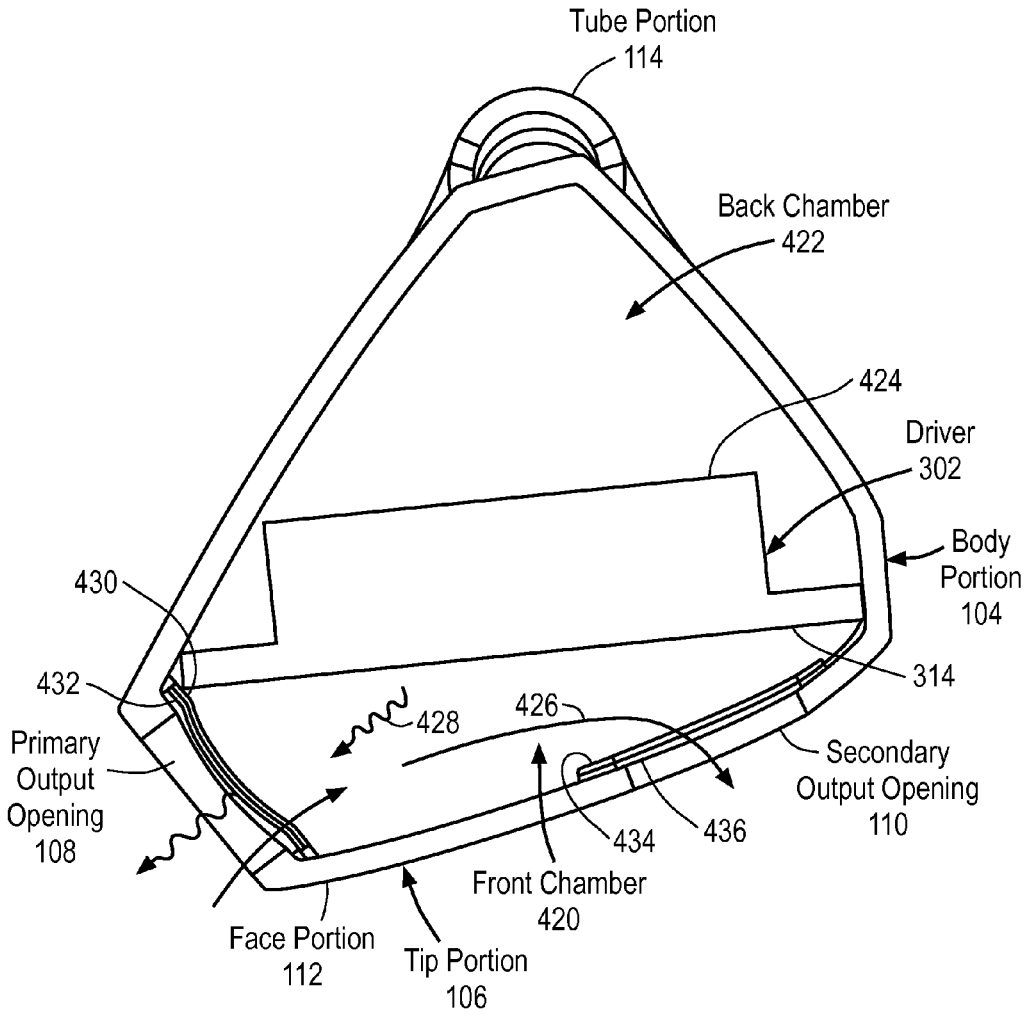
FIG. 4 illustrates a top perspective cut out view of one embodiment of an earphone.

As illustrated in FIG. 4, which is a more detailed representation of the earphone illustrated in FIG. 3, an acoustic and/or protective material may be disposed over one or both of primary output opening 108 and secondary output opening 110. Representatively, acoustic material 432 and protective material 430 may be disposed over primary output opening 108. Acoustic material 432 may be a piece of acoustically engineered material that provides a defined and intentional acoustic resistance or filtering effect. For example, in one embodiment, acoustic material 432 is a mesh or foam material that is manufactured to filter certain sound pressure waves output from driver 302. Protective material 430 may be an acoustically transparent material meaning that it does not significantly affect an acoustic performance of earphone 100. Rather, protective material 430 protects the device by preventing dust, water or any other undesirable materials or articles from entering housing 102. Protective material 430 may be, for example, a mesh, polymer or foam, or any other material that allows an essentially open passage for output of sound pressure waves from driver 302.

Similar to primary output opening 108, acoustic material 436 and protective material 434 may be disposed over secondary output opening 110. Similar to acoustic material 432, acoustic material 436 may be a mesh or foam material manufactured to filter a desired sound pressure wave output from driver 302. Protective material 434 may be an acoustically transparent material, for example, a mesh, polymer or foam, or any other material that protects earphone 100 from debris or articles and allows an essentially open passage for output of sound pressure waves from driver 302.

Acoustic materials 432, 436 and protective materials 430, 434 may each be single pieces that are combined over their respective openings to form a sandwich structure that can be snap fit over the openings. Alternatively, the materials may be glued or otherwise adhered over the openings. In some embodiments, acoustic materials 432, 436 and protective materials 430, 434 may also be composite materials or multilayered materials. Additionally, it is contemplated that acoustic materials 432, 436 and protective materials 430, 434 may be positioned over their respective openings in any order.

Body portion 104 is divided into a front chamber 420 and back chamber 422 formed around opposing faces of driver 302. Front chamber 420 may be formed around front face 314 of driver 302. In one embodiment, front chamber 420 is formed by body portion 104 and tip portion 106 of housing 102. In this aspect, sound waves 428 generated by front face 314 of driver 302 pass through front chamber 420 to the ear canal through primary output opening 108. In addition, front chamber 420 may provide an acoustic pathway for venting air waves 426 or an acoustic pressure within the ear canal out secondary output opening 110 to the external environment. As previously discussed, secondary output opening 110 is a calibrated opening therefore transmission of sound waves 428 and air waves 426 through secondary output opening 110 is controlled so that an acoustic performance of earphone 100 between users is consistent.

Back chamber 422 may be formed around the back face 424 of driver 302. Back chamber 422 is formed by body portion 104 of housing 102. The various internal acoustic components of earphone 100 may be contained within front chamber 420 and back chamber 422 as will be discussed in more detail in reference to FIG. 5.

Figure 5:
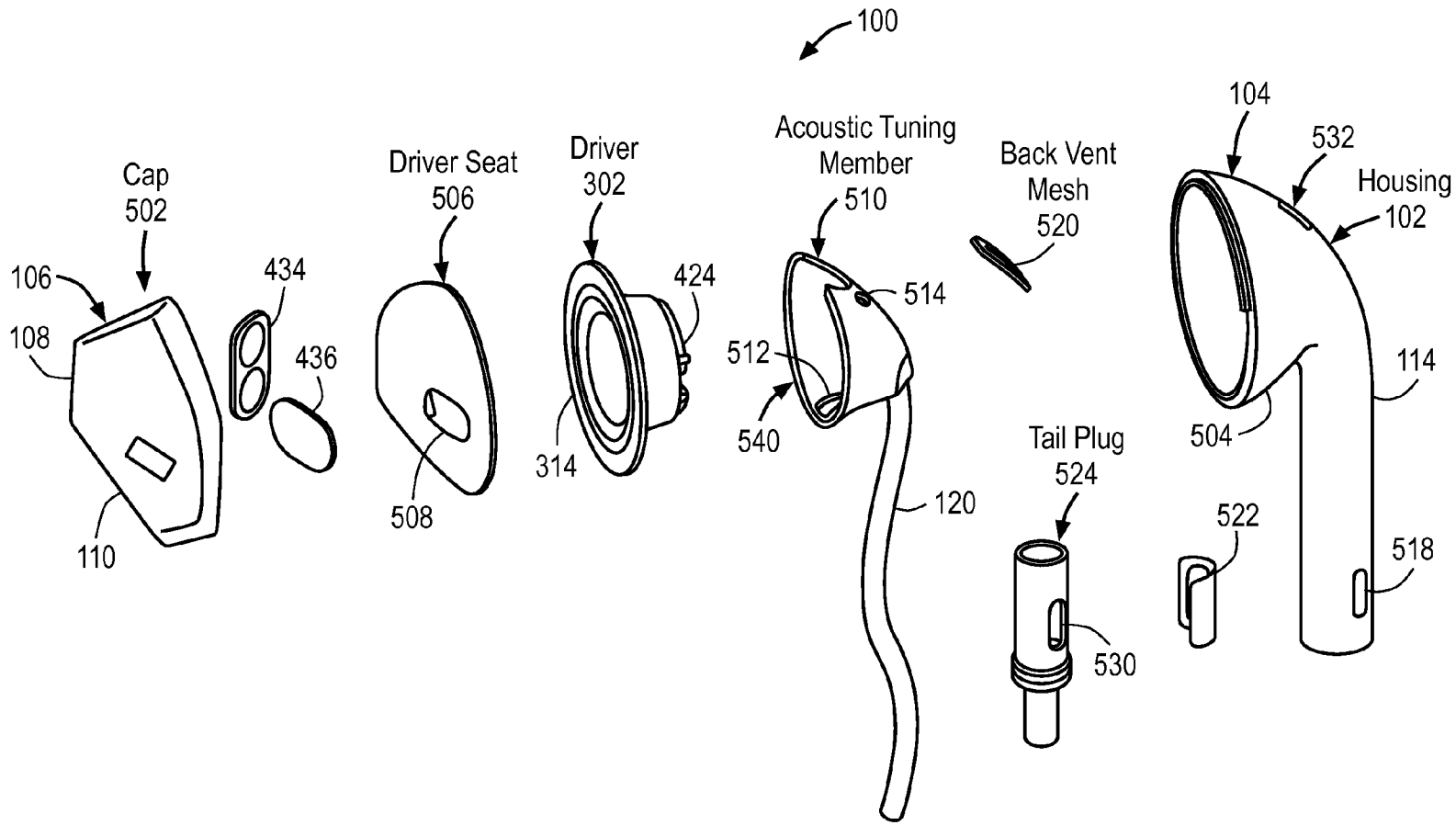
FIG. 5 illustrates an exploded perspective view of the internal acoustic components that can be contained within one embodiment of an earphone housing.

FIG. 5 illustrates an exploded perspective view of the internal acoustic components that can be contained within the earphone housing. Tip portion 106 of housing 102 may be formed by cap portion 502 which, in this embodiment, is shown removed from the base portion 504 of housing 102 to reveal the internal acoustic components that can be contained within housing 102. The internal acoustic components may include driver seat 506. Driver seat 506 may be dimensioned to fit within cap portion 502 and in front of front face 314 of driver 302. In one embodiment, driver seat 506 may seal to front face 314 of driver 302. Alternatively, driver seat 506 may be positioned in front of driver 302 but not directly sealed to driver 302. Driver seat 506 is therefore positioned within front chamber 420 previously discussed in reference to FIG. 4. Driver seat 506 may include output opening 508, which is aligned with secondary output opening 110 and includes similar dimensions so that sound generated by driver 302 can be output through driver seat 506 to secondary output opening 110. Driver seat 506 may include another output opening (not shown) that corresponds to and is aligned with primary output opening 108. Driver seat 502 may be, for example, a molded structure formed of the same material as housing 102 (e.g., a substantially rigid material such as plastic) or a different material (e.g., a compliant polymeric material).

Acoustic material 436 and protective material 434 may be held in place over secondary output opening 110 by driver seat 506. In one embodiment, acoustic material 436 and protective material 434 are positioned between driver seat 506 and secondary output opening 110. Alternatively, they may be attached to an inner surface of driver seat 506 and over opening 508 such that they overlap secondary output opening 110 when driver seat 506 is within cap portion 502. Although not illustrated, acoustic material 432 and protective material 430, which cover primary output opening 108, are also considered internal acoustic components. Acoustic material 432 and protective material 430 may be assembled over primary output opening 108 in a manner similar to that discussed with respect to materials 436, 434.

Acoustic tuning member 510 is positioned behind the back face 424 of driver 302 (i.e. within back chamber 422 illustrated in FIG. 4) and fits within base portion 504 of body portion 104. In one embodiment, acoustic tuning member 510 is positioned near back face 424 of driver 302 but is not directly attached to driver 302. In another embodiment, acoustic tuning member 410 can be directly attached to driver 302. When acoustic tuning member 510 is positioned near driver 302, acoustic tuning member 510 and body portion 104 define the back volume chamber of driver 302. The size and shape of a driver back volume chamber is important to the overall acoustic performance of the earphone. Since acoustic tuning member 510 defines at a least a portion of the back volume chamber, acoustic tuning member 510 can be used to modify the acoustic performance of earphone 100. For example, acoustic tuning member 510 can be dimensioned to tune a frequency response of earphone 100 by changing its dimensions.

In particular, the size of the back volume chamber formed around driver 302 by acoustic tuning member 510 and earphone housing 102 can dictate the resonance of earphone 100 within, for example, a frequency range of about 2 kHz to about 3 kHz (i.e., open ear gain). The ear canal typically acts like a resonator and has a particular resonance frequency when open and a different resonance frequency when closed. The acoustic response at the ear drum when the ear canal is open is referred to as the open ear gain. A resonance frequency around 2 kHz to 3 kHz is typically preferred by users. Acoustic tuning member 510 can be dimensioned to tune the resonance of earphone 100 to a frequency within this range. Specifically, when acoustic tuning member 510 occupies a larger region behind driver 302 (i.e., the air volume of the back volume chamber decreases), the open ear gain increases in frequency. On the other hand, when acoustic tuning member 510 occupies a smaller region behind driver 302 (i.e., the air volume within back volume chamber increases), the open ear gain decreases in frequency. The dimensions of acoustic tuning member 510 can therefore be modified to tune the resonance of earphone 100 to achieve the desired acoustic performance.

In addition, acoustic tuning member 510 may form an acoustic channel between the back volume chamber and an acoustic duct and bass port 518 formed within tube portion 114. The dimensions of the acoustic channel along with the acoustic duct and bass port 518, may also be selected to modify an acoustic performance of earphone 100. In particular, the dimensions may be selected to control a bass response (e.g., frequency less than 1 kHz) of the earphone as will be discussed in more detail below.

In typical earphone designs, the earphone housing itself defines the back volume chamber around the driver. Therefore the size and shape of the earphone housing affects the acoustic performance of the earphone. Acoustic tuning member 510, however, can be a separate structure within earphone housing 102. As such, the size and shape of acoustic tuning member 510 can be changed to achieve the desired acoustic performance without changing a size and shape of earphone housing 102. In addition, it is contemplated that an overall form factor of acoustic tuning member 510 may remain substantially the same while a size of certain dimensions, for example a body portion, may be changed to modify a size of the back volume chamber formed by acoustic tuning member 510, which in turn modifies the acoustic performance of the associated earphone. For example, acoustic tuning member 510 may be a substantially cone shaped structure. A thickness of the wall portion forming the end of the cone may be increased so that an air volume defined by acoustic tuning member 510 is smaller or the thickness may be decreased to increase the air volume. Regardless of the wall thickness, however, the outer cone shape is maintained. Thus, both an acoustic tuning member 510 defining a large air volume and another acoustic tuning member defining a relatively smaller air volume can fit within the same sized earphone housing.

The ability to modify the air volume defined by acoustic tuning member 510 without changing the form factor is important because acoustic performance varies from one driver to the next. Some aspects of the acoustic performance can be dictated by the size of the driver back volume chamber. Thus, one way to improve the acoustic consistency between drivers is by modifying the back volume chamber size. Since acoustic tuning member 510 defines the driver back volume, it may be manufactured to accommodate drivers of different performance levels. In addition, acoustic tuning member 510 can be separate from earphone housing 102, thus modifying its dimensions to accommodate a particular driver does not require an alteration to the design of earphone housing 102.

Acoustic tuning member 510 also includes acoustic output port 512 that acoustically connects the back volume chamber to an acoustic duct formed within tube portion 114 of housing 102. The acoustic duct is acoustically connected to bass port 518 formed within tube portion 114. Bass port 518 outputs sound from housing 102 to the external environment. Although a single bass port 518 is illustrated, it is contemplated that tube portion 114 may include more than one bass port, for example, two bass ports at opposing sides of tube portion 114.

In addition, acoustic tuning member 510 may include tuning port 514 which outputs sound from acoustic tuning member 510. Tuning port 514 may be aligned with tuning output port 532 formed in housing 102 so that the sound from acoustic tuning member 510 can be output to the external environment outside of housing 102. Each of acoustic output port 512, tuning port 514, the acoustic duct and bass port 518 are acoustically calibrated openings or pathways that enhance an acoustic performance of earphone 100 as will be discussed in more detail below.

Cable 120, which may include wires for transmitting power and/or an audio signal to driver 302, may be connected to acoustic tuning member 510. Cable 120 may be overmolded to acoustic tuning member 510 during a manufacturing process to provide added strain relief to cable 120. Overmolding of cable 120 to acoustic tuning member 510 helps to prevent cable 120 from becoming disconnected from driver 302 when a force is applied to cable 120. In addition to providing added strain relief, combining cable 120 and acoustic tuning member 510 into one mechanical part results in a single piece which takes up less space within earphone housing 102. A near end of the cable 120 and the acoustic tuning member 510 may therefore be assembled into earphone housing 102 as a single piece. In particular, to insert acoustic tuning member 510 into body portion 104, the far end of cable 120 is inserted into body portion 104 and pulled down through the end of tube portion 114 until acoustic tuning member 510 (with the near end of the cable 120 attached to it) is seated within base portion 504.

The internal components may further include a protective material formed over tuning port 514 and/or bass port 518 to prevent entry of dust and other debris. Representatively, protective mesh 520 may be dimensioned to cover tuning port 514 and protective mesh 522 may be dimensioned to cover bass port 518. Each of protective mesh 520 and protective mesh 522 may be made of an acoustically transparent material that does not substantially interfere with sound transmission. Alternatively, one or both of protective mesh 520, 522 may be made of an acoustic mesh material that provides a defined and intentional acoustic resistance or filtering effect. Protective mesh 520 and protective mesh 522 may be snap fit into place or held in place using an adhesive, glue or the like. Although not shown, it is further contemplated that in some embodiments, an additional acoustic material, such as those previously discussed in reference to FIG. 3, may also be disposed over tuning port 514 and/or bass port 518 to tune a frequency response of earphone 100.

Tail plug 524 may be provided to help secure cable 120 within tube portion 114. Tail plug 524 may be a substantially cylindrical structure having an outer diameter sized to be inserted within the open end of tube portion 114. In one embodiment, tail plug 524 may be formed of a substantially resilient material that can conform to the inner diameter of tube portion 114. In other embodiments, tail plug 524 may be formed of a substantially rigid material such as plastic. Tail plug 524 may be held within tube portion 114 by any suitable securing mechanism, for example, a snap fit configuration, adhesive, chemical bonding or the like. Tail plug 524 may include open ends and a central opening dimensioned to accommodate cable 120 so that cable 120 can run through tail plug 524 when it is inserted within tube portion 114. Connecting bass port 530 may also be formed through a side wall of tail plug 524. Connecting bass port 530 aligns with bass port 518 when tail plug 524 is inserted into tube portion 114 to facilitate sound travel out bass port 518.

In one embodiment, the internal acoustic components may be assembled to form earphone 100 as follows. Acoustic material 436 and protective material 434 may be placed over secondary output opening 110 and driver seat 506 may be inserted within cap portion 502 to hold materials 434, 436 in place. Acoustic material 432 and protective material 430 of primary output opening 108 may be assembled in a similar manner. Front face 314 of driver 302 may be attached to driver seat 506 so that driver 302 is held in place within cap portion 502. Cable 120, attached to acoustic tuning member 510, may be inserted into and through tube portion 114 though body portion 104 until acoustic tuning member 510 is positioned within body portion 504. Protective mesh 520, protective mesh 522 and tail plug 525 may be positioned within housing 102 prior to or after acoustic tuning member 510. Finally, driver 302 may be inserted within body portion 104 of housing 102. The foregoing is only one representative assembly operation. The internal acoustic components can be assembled in any manner and in any order sufficient to provide an earphone having optimal acoustic performance.

Figure 6A:
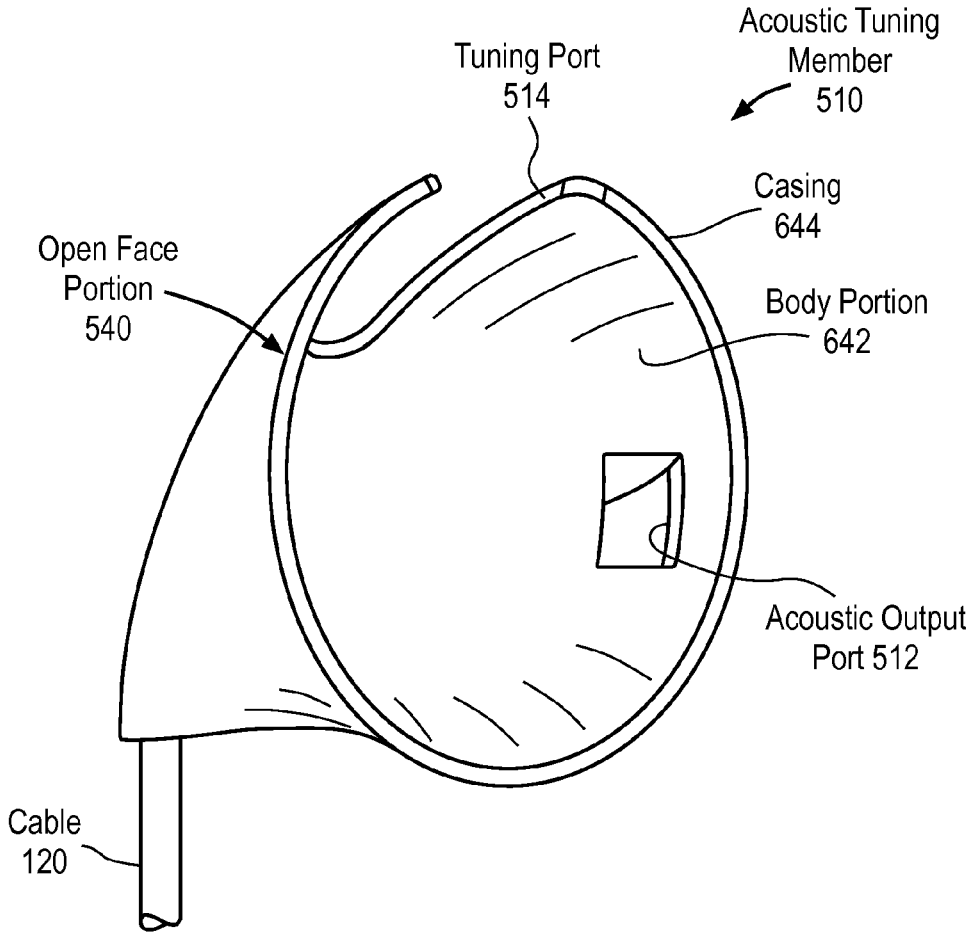
FIG. 6A illustrates a front perspective view of one embodiment of an acoustic tuning member.

FIG. 6A illustrates a front perspective view of one embodiment of an acoustic tuning member. Acoustic tuning member 510 is formed by tuning member housing or casing 644 having a substantially closed body portion 642 and open face portion 540 which opens toward driver 302 when positioned within earphone housing 102. Casing 644 may have any size and shape capable of tuning an acoustic response of the associated driver. In particular, the dimensions of casing 644 can be such that they help tune the midband and bass response of the earphone within which it is used. Representatively, in one embodiment, casing 644 forms a substantially cone shaped body portion 642 having an acoustic output port 512 acoustically coupled to an acoustic groove 646 (see FIG. 6B) formed within a back side of casing 644. Although a substantially cone shaped body portion 642 is described, other shapes are also contemplated, for example, a square, rectangular or a triangular shaped structure.

In one embodiment, acoustic output port 512 may be an opening formed through a wall of casing 644. Alternatively, acoustic output port 512 may be a slot formed inwardly from an edge of casing 644. Acoustic output port 512 outputs sound from acoustic tuning member 510 to acoustic groove 646. Acoustic groove 646 provides an acoustic pathway to an acoustic duct formed in tube portion 114. Acoustic output port 512 and acoustic groove 646 are dimensioned to tune an acoustic response of earphone 100. In this aspect, acoustic output port 512 and acoustic groove 646 are calibrated in the sense that they have been tested or evaluated (in at least one specimen of a manufactured lot) for compliance with a given specification or design parameter. In other words, they are not just random openings or grooves, but intentionally formed for a particular purpose, namely to modify the frequency response of the earphone in a way that helps to tune the frequency response and improve a bass response.

For example, it is recognized that acoustic inductance within earphone 100 controls a midband response and bass response of earphone 100. In addition, the acoustic resistance within earphone 100 can affect the bass response. Thus, a size and shape of acoustic output port 512 and acoustic groove 646 may be selected to achieve a desired acoustic inductance and resistance level that allows for optimal midband and bass response within earphone 100. In particular, increasing an acoustic mass within earphone 100 results in greater sound energy output from earphone 100 at lower frequencies. The air mass within earphone 100, however, should be maximized without increasing the acoustic resistance to an undesirable level. Thus, acoustic output port 512 and acoustic groove 646 may be calibrated to balance the acoustic inductance and acoustic resistance within earphone 100 so that an acoustically desirable midband and bass response are achieved. Representatively, acoustic output port 512 may have a surface area of from about 0.5 $mm^2$ to about 4 $mm^2$, or from about 1 $mm^2$ to about 2 $mm^2$, for example, about 1.3 $mm^2$. Acoustic output port 512 may have a height dimension that is different than its width dimension, for example, the height dimension may be slightly larger than the width dimension. Alternatively, a height and width dimension of acoustic output port 512 may be substantially the same.

Acoustic groove 646 may have cross sectional dimensions substantially matching that of acoustic output port 512. As previously discussed, acoustic groove 646 may be a groove formed within a back side of casing 644. Acoustic groove 646 extends from acoustic output port 512 toward the back end of casing 644. When acoustic tuning member 510 is positioned within earphone housing 102, acoustic groove 646 mates with housing groove 648 formed along an inner surface of housing 102 to form a closed acoustic channel 650 (see FIG. 6C) between acoustic output port 512 and tube portion 114. Alternatively, housing groove 648 may be omitted and acoustic groove 646 may form acoustic channel 650 by mating with any inner surface of housing 102, or acoustic groove 646 may be formed as a closed channel such that it does not need to mate with any other surface to form acoustic channel 650. Sound waves within the back volume chamber formed by acoustic tuning member 510 travel from acoustic tuning member 510 to tube portion 114 through acoustic channel 650. A length, width and depth of acoustic groove 646 (and the resulting acoustic channel 650) may be such that an acoustically desirable midband and bass response are achieved by earphone 100. Representatively, the length, width and depth may be large enough to allow for optimal acoustic mass within earphone 100 without increasing the resistance to an undesirable level.

Figure 6B:
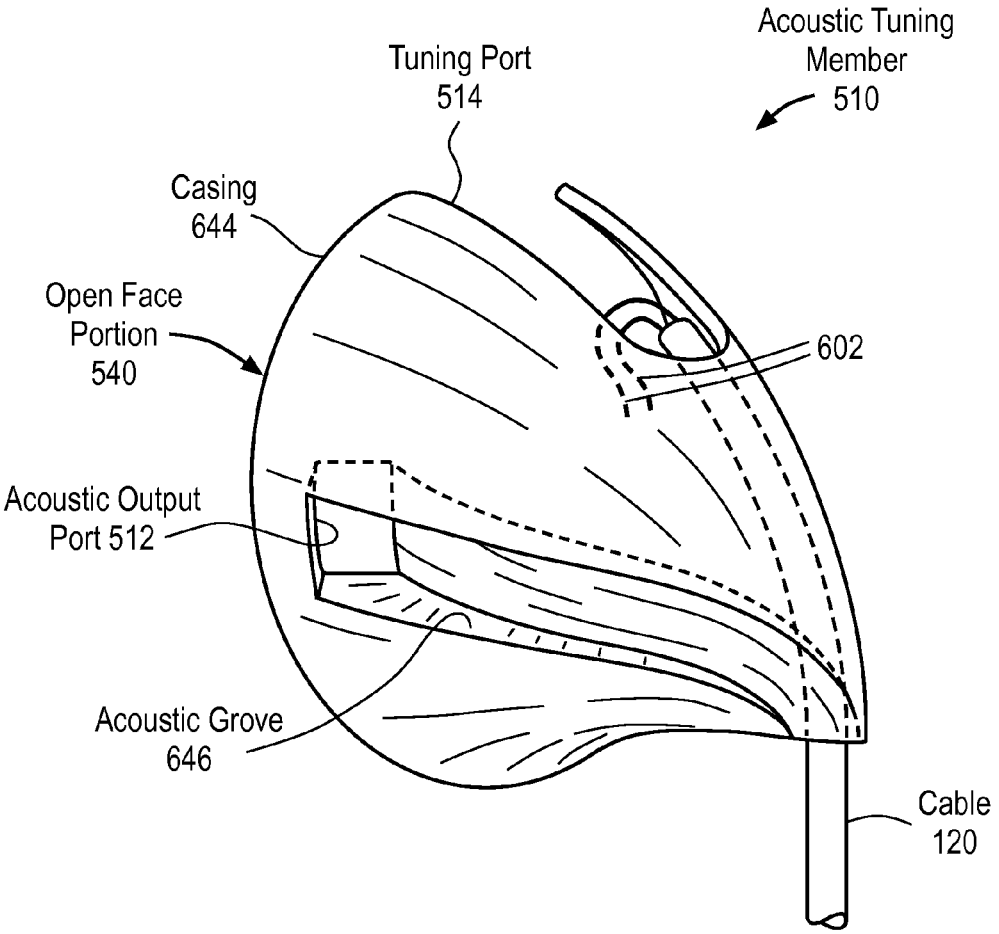
FIG. 6B illustrates a back perspective view of one embodiment of an acoustic tuning member.

Referring back to FIGS. 6A-6B, tuning port 514 may be formed along a top portion of acoustic tuning member 510. In one embodiment, tuning port 514 is a slot extending from an outer edge of open face portion 540. Alternatively, tuning port 514 may be an opening formed near the outer edge but does not extend through the outer edge. In addition to its tuning functions, tuning port 514 may also be dimensioned to accommodate wires 602 extending from cable 120 to the driver, as shown in FIG. 6B. Representatively, cable 120 may be overmolded along a back side of body portion 642 such that an open end of cable 120 is positioned near tuning port 514. Wires 602 extending from the open end of cable 120 may pass through tuning port 514 and attach to electrical terminals for example on the back side of the driver, to provide power and/or an audio signal to the driver.

Acoustic tuning member 510 may be formed by molding a substantially non-compliant material such as a plastic into the desired shape and size. Alternatively, acoustic tuning member 510 may be formed of any material, such as a compliant or resilient material, so long as it is capable of retaining a shape suitable for enhancing an acoustic performance of earphone 100. Acoustic tuning member 510 may be formed separate from housing 102 such that it rests, or is mounted, inside of earphone housing 102. Since acoustic tuning member 510 is a separate piece from earphone housing 102 it may have a different shape than earphone housing 102 and define a back volume chamber having a different shape than back chamber 422 formed without earphone housing 102. Alternatively, housing 102 and acoustic tuning member 510 may be integrally formed as a single piece.

FIG. 6B illustrates a back side perspective view of acoustic tuning member 510. From this view it can be seen that acoustic groove 646 is formed by a back side of acoustic tuning member 510 and extends from acoustic output port 512 toward the back end of acoustic tuning member 510.

Figure 6C:
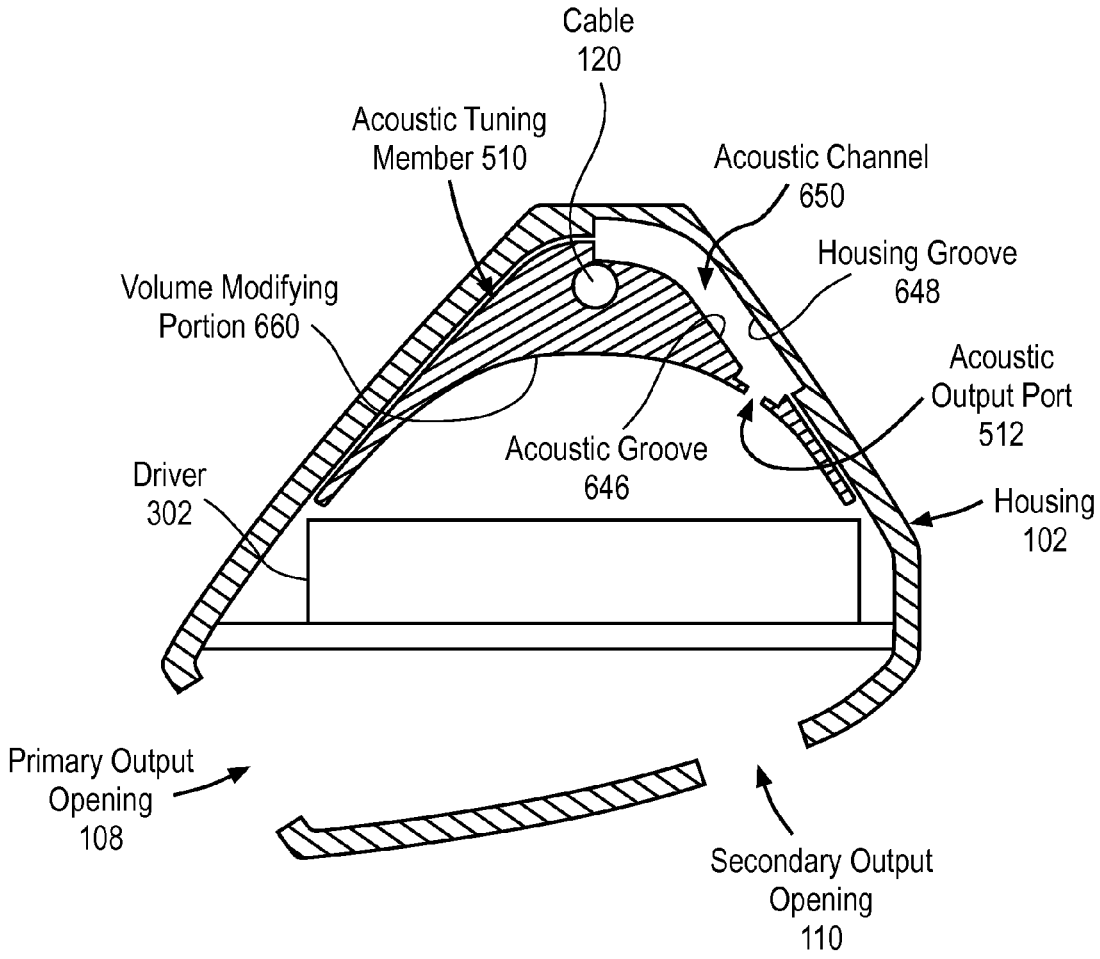
FIG. 6C illustrates a cross-sectional top view of one embodiment of an acoustic tuning member.

FIG. 6C illustrates a cross-sectional top view of acoustic tuning member 510 positioned within earphone housing 102. As can be seen from this view, when acoustic tuning member 510 is positioned within housing 102, acoustic groove 646 is aligned with housing groove 648 formed along an inner surface of housing 102 to form acoustic channel 650. Acoustic channel 650 extends from acoustic output port 512 to tube portion 114 so that sound within the back chamber defined by acoustic tuning member 510 can travel from the back volume chamber to tube portion 114 as will be described in more detail in reference to FIG. 7 and FIG. 8.

Still referring to FIG. 6C, in addition to the acoustic characteristics achieved by acoustic output port 512 and acoustic groove 646, body portion 642 may include a volume modifying portion 660 that can be increased or decreased in size during a manufacturing process to change the air volume within acoustic tuning member 510. As previously discussed, acoustic tuning member 510 defines the back volume chamber around a driver within the earphone housing. Thus, increasing the air volume within acoustic tuning member 510 also increases the back volume chamber, which modifies the acoustic performance of earphone 100. Decreasing the air volume within acoustic tuning member 510 decreases the back volume chamber. The volume modifying portion 660 can have any size and shape and be positioned along any portion of the inner surface of acoustic tuning member 510 sufficient to change the volume of the back volume chamber defined by acoustic tuning member 510. For example, volume modifying portion 660 may be positioned along a center region of acoustic tuning member 510 such that the inner profile of acoustic tuning member 510 has a substantially curved shape. Volume modifying portion 660 can be formed by thickening portions of the wall of acoustic tuning member 510 or mounting a separate plug member within acoustic tuning member 510. In addition, the size and shape of volume modifying portion 660 can be changed without modifying an overall form factor of acoustic tuning member 510. Thus, during manufacturing, one acoustic tuning member 510 can be made to define a large air volume while another defines a smaller air volume, yet both can fit within the same type of earphone housing 102 because they have the same overall form factor. Cable 120 can be overmolded within volume modifying portion 660 of acoustic tuning member 510 as illustrated in FIG. 6C. In other embodiments, cable 120 can be overmolded within any portion of acoustic tuning member 510.

Figure 7:
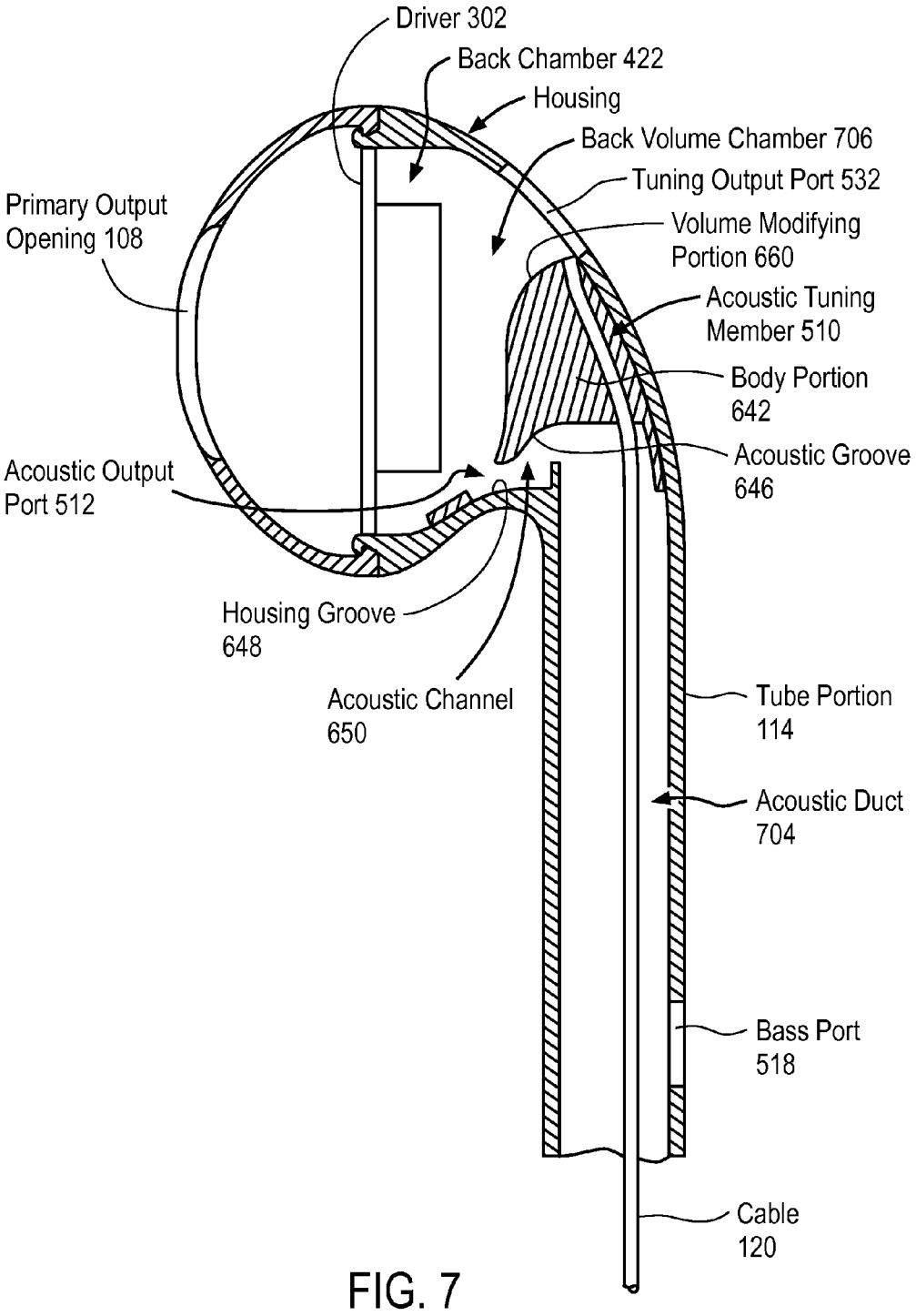
FIG. 7 illustrates a cross-sectional side view of one embodiment of an earphone having an acoustic tuning member.

FIG. 7 illustrates a cross-sectional side view of one embodiment of an earphone. Acoustic tuning member 510, along with a portion of housing 102, are shown forming back volume chamber 706 around driver 302. As can be seen from this view, volume modifying portion 660 of acoustic tuning member 510 occupies a substantial area within back chamber 422 defined by earphone housing 102 therefore a size of back volume chamber 706 is smaller than housing back chamber 422. As previously discussed, a size and shape of volume modifying portion 660 can be modified to achieve a back volume chamber 706 of a desired size.

Sound waves generated by the back face of driver 302 can be transmitted through acoustic channel 650 to acoustic duct 704 formed within tube portion 114 of earphone 100. Acoustic channel 650 provides a defined acoustic path for transmitting sound from driver 302 to acoustic duct 704. As previously discussed, acoustic channel 650 may be an enclosed channel formed by aligning or mating acoustic groove 646 along an outer surface of acoustic tuning member 510 and housing groove 648 along an inner surface of earphone housing 102. Alternatively, acoustic channel 650 may be formed by one of acoustic groove 646 or housing groove 648, or a separate structure mounted within housing 102.

Acoustic duct 704 may be a conduit formed within tube portion 114 that allows air or sound to pass from one end of tube portion 114 to another end. Air or sound passing through acoustic duct 704 may exit acoustic duct 704 through bass port 518 so that sound within acoustic duct 704 can be output to the environment outside of housing 102.

In addition to providing a sound pathway, acoustic duct 704 may also accommodate cable 120 and the various wires traveling through cable 120 to driver 302. In particular, cable 120 may travel through acoustic duct 702 and the back side of acoustic tuning member 510. As previously discussed, the wires within cable 120 may extend out the end of cable 120 and through tuning port 514 so that they can be attached to driver 302.

Figure 8:
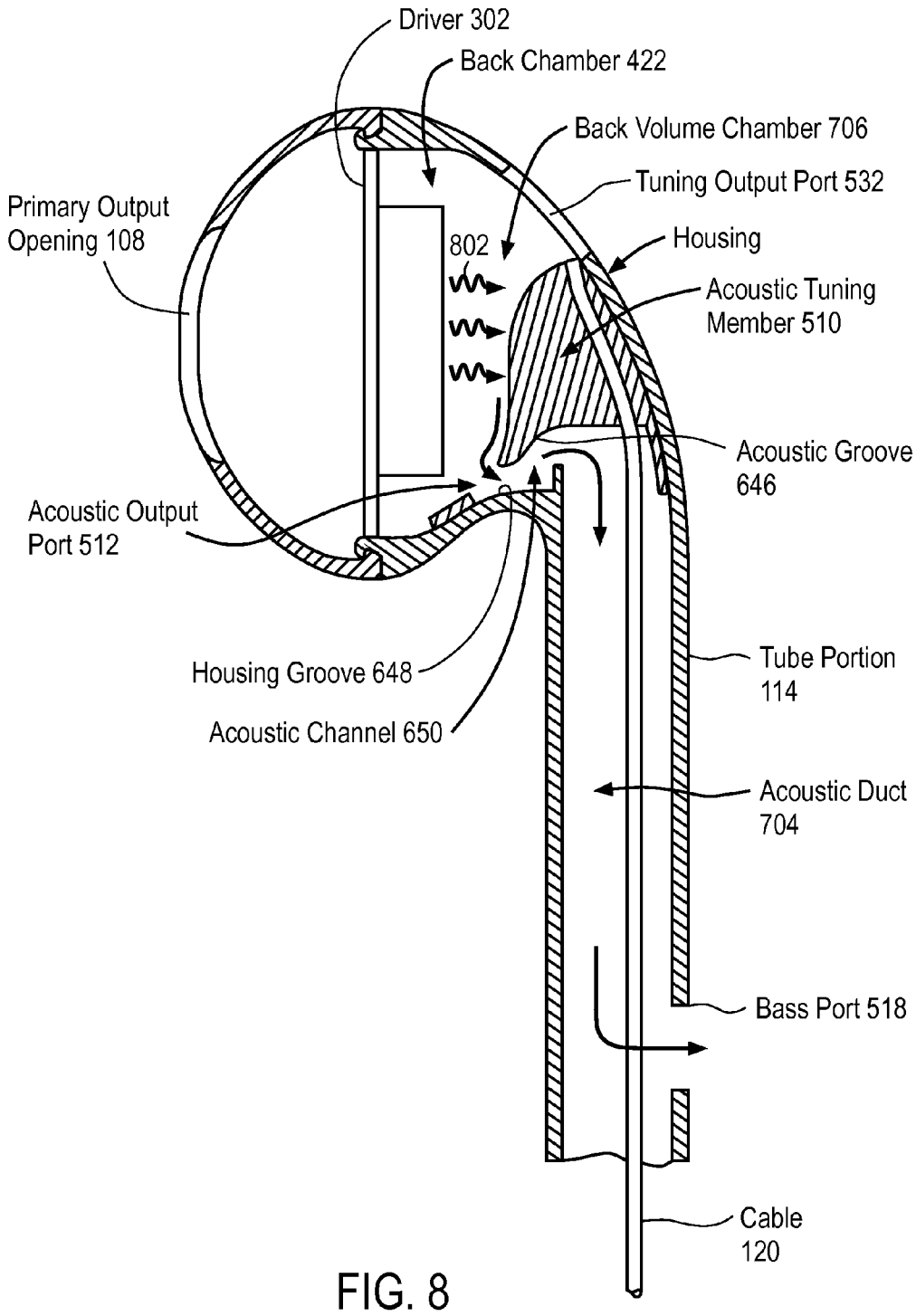
FIG. 8 illustrates a cross-sectional side view of one embodiment of an earphone having an acoustic tuning member.

FIG. 8 illustrates a cross-sectional side view of one embodiment of an earphone. The transmission of sound waves 802 generated by the back face of driver 302 through earphone 100 is illustrated in FIG. 8. In particular, from this view, it can be seen that acoustic tuning member 510 and housing 102 form back volume chamber 706 around the back side of driver 302. Sound waves 802 generated by driver 302 travel into back volume chamber 706. Sound waves 802 can exit back volume chamber 706 through acoustic output port 512. From acoustic output port 512, sound waves 802 travel through acoustic channel 650 to acoustic duct 704. Sounds waves 802 traveling along acoustic duct 704 can exit acoustic duct 704 to the surrounding environment through bass port 518. It is further noted that sound waves 802 may also exit back volume chamber 706 to the surrounding environment through the tuning port of acoustic tuning member 510, which is aligned with tuning output port 532 formed in housing 102.

Each of acoustic output port 512, acoustic channel 650, acoustic duct 704 and bass port 518 are calibrated to achieve a desired acoustic response. In particular, as the cross-sectional area of each of these structures decreases, the acoustic resistance within back volume chamber 706 increases. Increasing the acoustic resistance, decreases the bass response. Therefore, to increase the bass response of earphone 100, a cross-sectional area of one or more of acoustic output port 512, acoustic channel 650, acoustic duct 704 and bass port 518 can be increased. To decrease the bass response, the cross-sectional area of one or more of acoustic output port 512, acoustic channel 650, acoustic duct 704 and bass port 518 is decreased. In one embodiment, the cross-sectional area of acoustic output port 512, acoustic channel 650, acoustic duct 704 and bass port 518 may range from about 1 $mm^2$ to about 8 $mm^2$, for example, from 3 $mm^2$ to about 5 $mm^2$, representatively about 4 $mm^2$.

Additionally, or alternatively, where a smaller cross sectional area of one or more of acoustic output port 512, acoustic channel 650, acoustic duct 704 and bass port 518 is desired, a size and shape of volume modifying portion 660 within acoustic tuning member 510 may be decreased to balance any increases in resistance caused by the smaller pathways. In particular, decreasing the size and/or shape of volume modifying portion 660 will increase back volume chamber 706 formed by acoustic tuning member 510. This larger air volume will help to reduce acoustic resistance and in turn improve the bass response.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the secondary output opening, also referred to herein as the leak port, may have any size and shape and be formed within any portion of the earphone housing suitable for improving an acoustic response of the earphone. For example, the secondary output opening may be formed within a side portion of the housing that does not face the pinna portion of the ear when the earphone is positioned within the ear, such as a top side or a bottom side of the earphone housing, or a side of the housing opposite the pinna portion of the ear. Still further, acoustic tuning member may be used to improve an acoustic response of any type of earpiece with acoustic capabilities, for example, circumaural headphones, supra-aural headphones or a mobile phone headset. The description is thus to be regarded as illustrative instead of limiting.

What is claimed is:

1. An earphone comprising:

an earphone housing having a tip portion dimensioned to be inserted into an ear of a wearer while an outer surface of the tip portion is in contact with the ear, and a body portion extending outward from the tip portion, wherein the body portion has a face portion that faces a pinna region of the ear when the tip portion is inserted into the ear;

a primary output opening formed in the tip portion, the primary output opening to output sound, generated by a diaphragm of a driver contained within the earphone housing, into the ear; and a secondary output opening formed in the face portion, the secondary output opening to vent the ear to a surrounding environment, wherein the primary output opening and the secondary output opening face different directions and are positioned in front of a sound output face of the driver.

2. The earphone of claim 1 wherein the body portion rests within a concha of the ear when the tip portion is inserted into the ear.

3. The earphone of claim 1 wherein an end portion of the driver extends into the tip portion of the earphone housing.

4. The earphone of claim 1 wherein the secondary output opening is calibrated to modify a sound pressure level at around 6 kHz.

5. The earphone of claim 1 wherein the secondary output opening has a surface area of from 3 $mm^2$ to 12 $mm^2$.

6. The earphone of claim 1 wherein the secondary output opening has an aspect ratio of 3:2.

7. The earphone of claim 1 wherein the secondary output opening has an elongated shape that is oriented in a substantially horizontal direction when the tip portion is inserted into the ear.

8. The earphone of claim 1 wherein the secondary output opening is dimensioned to provide consistency in an acoustic performance of the earphone when worn by different users.

9. The earphone of claim 1 wherein the primary output opening and the secondary output opening are aligned with, and facing, the sound output face of the driver.

10. The earphone of claim 1 wherein the tip portion and the body portion are formed of a non-compliant material.

11. An earphone comprising:

an earphone housing having a tip portion dimensioned to be inserted into an ear of a wearer and a body portion extending outward from the tip portion, wherein the body portion has a face portion that faces a pinna region of the ear when the tip portion is inserted into the ear;

a primary output opening formed in the tip portion, the primary output opening to output sound from a driver contained within the housing into the ear; and a secondary output opening formed in the face portion such that it faces a different direction than the primary output opening, the secondary output opening to vent the ear to a surrounding environment, wherein the primary output opening and the secondary output opening are on the same side of the driver and an angle formed at an intersection between a first axis through a center of the primary output opening and a second axis through a center of the secondary output opening is less than 90 degrees.

12. The earphone of claim 11 wherein the body portion rests within a concha of the ear when the tip portion is inserted into the ear.

13. The earphone of claim 11 wherein the secondary output opening modifies a sound pressure frequency response of the primary output opening.

14. The earphone of claim 11 wherein the secondary output opening has a surface area of from 3 $mm^2$ to 12 $mm^2$.

15. The earphone of claim 11 wherein the secondary output opening has an aspect ratio of 3:2.

16. The earphone of claim 11 wherein the secondary output opening has an elongated shape that is oriented in a substantially horizontal direction when a tube portion extending perpendicular to the body portion is positioned vertically downward.

17. An earphone comprising:

an earphone housing having a non-compliant tip portion dimensioned to be inserted into and contact an ear of a wearer and a body portion extending outward from the tip portion, the body portion having a face portion that faces a pinna region of the ear when the tip portion is inserted into the ear;

a primary output opening formed in the tip portion to output sound from a driver contained within the housing into the ear; and a secondary output opening formed in the face portion to vent the ear to a surrounding environment and modify a sound pressure frequency response of the primary output opening.

18. The earphone of claim 17 wherein the tip portion and the body portion are formed of the same material.

19. The earphone of claim 17 wherein an angle formed at an intersection between a first axis through a center of the primary output opening and a second axis through a center of the secondary output opening is less than 90 degrees.

20. The earphone of claim 17 wherein the primary output opening and the secondary output opening are horizontally aligned with one another when a tube portion extending perpendicular to the body portion is positioned vertically downward.

* * * * *